US007568466B2

(12) United States Patent
Nonogaki

(10) Patent No.: US 7,568,466 B2
(45) Date of Patent: Aug. 4, 2009

(54) CONTROL SYSTEM AND TIMING ROTOR FOR MULTI-CYLINDER INTERNAL COMBUSTION ENGINE

(75) Inventor: Yoshihiko Nonogaki, Kariya (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 190 days.

(21) Appl. No.: 11/644,902

(22) Filed: Dec. 26, 2006

(65) Prior Publication Data

US 2007/0144487 A1 Jun. 28, 2007

(30) Foreign Application Priority Data

Dec. 26, 2005 (JP) ..... 2005-372162
Jul. 28, 2006 (JP) ..... 2006-205787

(51) Int. Cl.
*F02P 5/00* (2006.01)

(52) U.S. Cl. ..... 123/406.58

(58) Field of Classification Search ..... 123/295, 123/299, 301, 406.18, 406.58; 73/114.25, 73/114.26, 114.28
See application file for complete search history.

(56) References Cited

U.S. PATENT DOCUMENTS 4,967,709 A * 11/1990 Ozawa ..... 123/406.65
4,972,818 A * 11/1990 Nomura et al. ..... 123/406.13
5,269,391 A * 12/1993 Ito et al. ..... 180/197
5,535,620 A * 7/1996 Nichols ..... 73/114.69
6,138,638 A * 10/2000 Morikawa ..... 123/295
6,612,296 B1 * 9/2003 Yonezawa et al. ..... 123/612
6,805,110 B2 * 10/2004 Park ..... 123/609
6,961,652 B2 11/2005 Amano
6,968,269 B2 * 11/2005 Yamashita ..... 701/114
7,082,362 B2 * 7/2006 Asama ..... 701/103
2001/0045210 A1 * 11/2001 Itoyama ..... 123/568.21
2002/0020396 A1 * 2/2002 Sakamoto ..... 123/492
2002/0026925 A1 * 3/2002 Yuya ..... 123/406.53
2003/0217734 A1 * 11/2003 Ito et al. ..... 123/299
2005/0027430 A1 * 2/2005 Amano ..... 701/105

FOREIGN PATENT DOCUMENTS

JP 3076556 6/2000

* cited by examiner

*Primary Examiner*—Stephen K Cronin
*Assistant Examiner*—Sizo B Vilakazi
(74) *Attorney, Agent, or Firm*—Nixon & Vanderhye PC

(57) ABSTRACT

An angular interval between a piston top dead center of one of two cylinders of an engine and a piston top dead center of the other one of the two cylinders is not a quotient of 360° CA divided by an integer number. A timing rotor is rotated synchronously with a crankshaft of the engine and includes a plurality of teeth that are arranged at equal intervals, each of which is set as a predetermined quotient of the angular interval divided by a corresponding integer number.

5 Claims, 9 Drawing Sheets

V2 CYLINDERS, V ANGLE 55°
13°45′ PULSE×24, NON-TOOTHED PORTION : 43°45′
#1 IGNITION
#2 IGNITION
#1
#2
INTAKE STROKE
COMPRESSION STROKE
COMBUSTION STROKE
EXHAUST STROKE
720°CA
43°45′
13°45′×19+43°45′=305°
55°
CRANK ANGLE
TEETH

V2 CYLINDERS, V ANGLE 53°
17°40′ PULSE×18, NON-TOOTHED PORTION : 59°40′
59°40′
17°40′×14+59°40′=307°
53°

13°15′ PULSE×25, NON-TOOTHED PORTION : 42°
42°
13°15′×20+42°=307°
53°

CONTROL SYSTEM AND TIMING ROTOR FOR MULTI-CYLINDER INTERNAL COMBUSTION ENGINE

CROSS REFERENCE TO RELATED APPLICATION

This application is based on and incorporates herein by reference Japanese Patent Application No. 2005-372162 filed on Dec. 26, 2005 and Japanese Patent Application No. 2006-205787 filed on Jul. 28, 2006.

BACKGROUND OF THE INVENTION

1. Field of the Invention

The present invention relates to a control system and a timing rotor for a multi-cylinder internal combustion engine.

2. Description of Related Art

For example, Japanese Patent Number 3076556B2 recites a two cylinder V-type internal combustion engine, in which an angular interval between a top dead center of one of two cylinders and a top dead center of the other one of the two cylinders is set to be 60° CA. This internal combustion engine has a timing rotor, which is provided to sense a rotational angle at the time of outputting the force from the engine. The timing rotor has two teeth, which are spaced from each other by an amount that corresponds to an angular interval between the top dead center of the one cylinder and the top dead center of the other cylinder. When a corresponding one of these teeth is sensed by a rotational angle sensor, an ignition pulse signal of the corresponding cylinder is generated.

Recently, even for this type of multi-cylinder internal combustion engine, it has been demanded to more accurately set ignition timing, fuel injection start timing and a fuel injection period. However, when the above timing rotor is used, the ignition timing needs to be set based on an average required time period, which is required for the timing rotor to make one full rotation, and an average rotational speed of the timing rotor during the one rotation. It is difficult to perform this with high accuracy.

Here, it is conceivable to use a timing rotor that has multiple teeth arranged at equal angular intervals, each of which is a quotient of a full rotational angle of the timing rotor divided by an integer number. However, in such a case, when the above internal combustion engine is one, in which an angular interval between the piston top dead center of the one cylinder and the closest one of the piston top dead center and the piston bottom dead center of the other cylinder is not a quotient of the full rotational angle of the output shaft, the ignition timing cannot be set with high accuracy. For example, this is a case where the above angular interval of the teeth is set to be 55° CA, which is not a quotient of the full rotational angle of the output shaft. This is due to the fact that the interval between the piston top dead center and the corresponding tooth varies from one cylinder to another cylinder.

SUMMARY OF THE INVENTION

The present invention addresses the above disadvantage. To address the above disadvantage, there is provided a control system for controlling an output of a multi-cylinder internal combustion engine. An angular interval between a piston top dead center of one of corresponding two cylinders of the engine and a closest one of a piston top dead center and a piston bottom dead center of the other one of the two cylinders, which is closest to the piston top dead center of the one of the two cylinders, is not a quotient of a full rotational angle of an output shaft of the engine divided by an integer number. The control system includes a timing rotor and a sensing means. The timing rotor is rotated synchronously with the output shaft and includes a plurality of sensing subject portions that are arranged at equal intervals, each of which is set as a predetermined quotient of the angular interval divided by a corresponding integer number. The sensing means is for sensing the plurality of sensing subject portions of the timing rotor.

To address the above disadvantage, there is also provided a control system for controlling an output of a multi-cylinder internal combustion engine. An angular interval between a piston top dead center of one of corresponding two cylinders of the engine and a closest one of a piston top dead center and a piston bottom dead center of the other one of the two cylinders, which is closest to the piston top dead center of the one of the two cylinders, is not a quotient of a full rotational angle of an output shaft of the engine divided by an integer number. The control system includes a timing rotor, a sensing means and an operational time setting means. The timing rotor is rotated synchronously with the output shaft and includes a plurality of sensing subject portions that are arranged at equal intervals, each of which is set as a predetermined quotient of the full rotational angle of the output shaft divided by a corresponding integer number. The sensing means is for sensing the plurality of sensing subject portions of the timing rotor. The operational timing setting means is for setting at least operational timing of an actuator provided to the one of the two cylinders to control the output of the engine. The operational timing setting means sets a specific angle of the output shaft, which is set for the one of the two cylinders and is linked with an operation of the actuator, to coincide with timing of sensing a specific one of the plurality of sensing subject portions, which is sensed by the sensing means, in a predetermined operational state of the engine.

To address the above disadvantage, there is also provided a timing rotor for a multi-cylinder internal combustion engine. The timing rotor is rotated synchronously with an output shaft of the engine, and an angular interval between a piston top dead center of one of corresponding two cylinders of the engine and a closest one of a piston top dead center and a piston bottom dead center of the other one of the two cylinders, which is closest to the piston top dead center of the one of the two cylinders, is not a quotient of a full rotational angle of the output shaft divided by an integer number. The timing rotor includes a plurality of sensing subject portions that are sensed by an external sensing means for sensing a rotational angle of the output shaft and are arranged at equal intervals, each of which is set as a predetermined quotient of the angular interval divided by a corresponding integer number.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

FIRST EMBODIMENT

A first embodiment according to the present invention will be described with reference to the accompanying drawings. A control system and a timing rotor of an internal combustion engine according to the embodiment of the present invention are implemented in a two cylinder V-type gasoline engine installed in a motorcycle.

Figure 1:
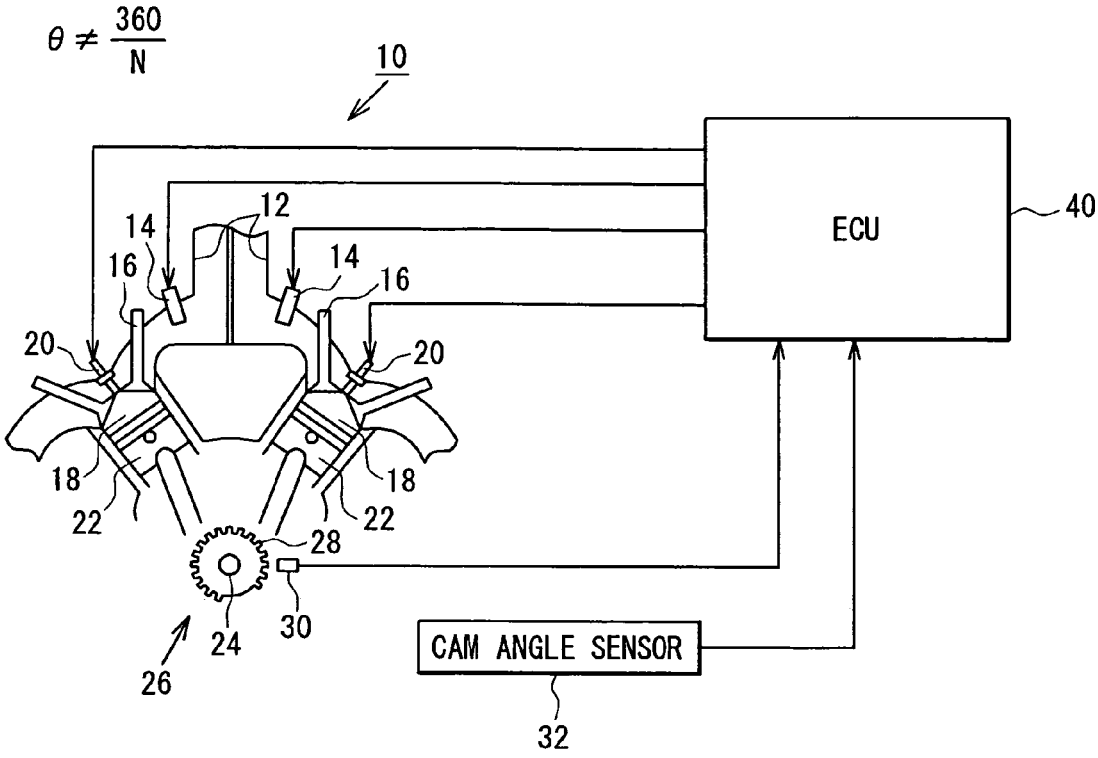
FIG. 1 is a diagram schematically showing an entire structure of an engine system according to a first embodiment of the present invention.

FIG. 1 schematically shows an entire structure of an engine system according to the present embodiment.

As shown in FIG. 1, a fuel injection valve (actuator) 14 is provided for each cylinder and is installed in a corresponding intake air passage 12 of the gasoline engine 10. Furthermore, each intake air passage 12 is communicated with a corresponding combustion chamber 18 upon opening of a corresponding intake valve 16. A spark plug (actuator) 20 is provided to the combustion chamber 18. A mixture of air, which is supplied to the intake air passage 12, and fuel, which is injected from the fuel injection valve 14, is combusted in the combustion chamber 18 upon generation of a spark from the spark plug 20 through ignition of the spark plug 20. A rotational force of a crank shaft (output shaft) 24 is generated through each corresponding piston 22 due to the thus generated combustion energy.

Furthermore, the engine system includes various sensors for sensing an operational state of the gasoline engine 10. These sensors include a rotational angle sensor 30 and a cam angle sensor 32. The rotational angle sensor 30 senses teeth (sensing subject portions) 28 of a timing rotor 26, which is provided to the crankshaft 24. The cam angle sensor 32 senses a rotational angle of a camshaft.

An electronic control unit (ECU) 40 includes a microcomputer as its main component. The ECU 40 controls an output of the gasoline engine 10 based on measurements of the above sensors. Particularly, the ECU 40 performs a fuel injection control operation and an ignition timing control operation of the gasoline engine 10 to control the output of the gasoline engine 10.

Now, the timing rotor 26 of the present embodiment will be described.

At the time of performing the fuel injection control operation or the ignition timing control operation, when the timing needs to be finely adjusted, it is desirable to convert a rotational angle, which is measured between the timing of sensing one of the teeth 28 and the desired timing, into a corresponding time period. In order to execute this time conversion, it is desirable to compute a local rotational speed, which is measured at a rotational angle or a rotational angular range that is placed as close as possible to the one of the teeth 28. Furthermore, the angular interval, which is measured between the timing of sensing the one of the teeth 28 and the desired timing, should not be excessively large. Because of the above points, it is desirable to set the number of the teeth 28 as large as possible.

Furthermore, at this time, it is also desirable that the teeth 28 are arranged one after another at equal intervals. When the intervals of the teeth 28 vary, the following disadvantage may be encountered. Specifically, the crankshaft 24 normally experiences rotational fluctuations. Thus, when the intervals of the teeth 28 are not uniform, it is difficult to determine which one of the teeth 28 is sensed based on the output of the rotational angle sensor 30.

The following operation is desirable. That is, in a predetermined operational state of the gasoline engine 10, when a particular one of the teeth 28 is sensed, the spark plug 20 ignites the air/fuel mixture. In view of the above point, it is desirable to provide reference teeth 28, each of which is associated with the ignition timing of the corresponding cylinder.

According to the present embodiment, an angular interval θ between a top dead center of one piston 22 and a top dead center of the other piston 22 is set to be 55° CA. Thus, in the case of the prior art timing rotor, in which a unit angular interval of the teeth is set to be a quotient of 360° CA divided by an integer number, the reference ignition timing of each cylinder cannot be correlated with the corresponding one of the teeth.

Figure 2:
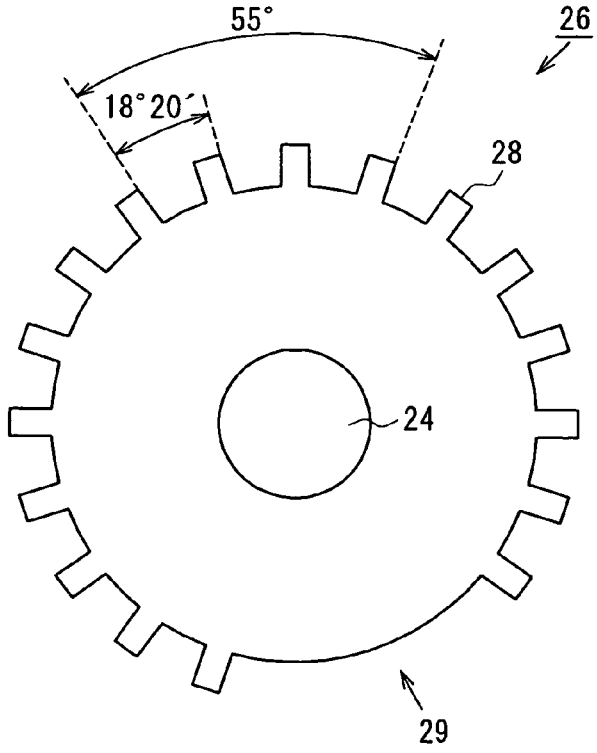
FIG. 2 is an enlarged plan view showing a structure of a timing rotor of the first embodiment.

In view of this, according to the present embodiment, as shown in FIG. 2, the teeth 28 are arranged at equal intervals of 18° 20', which is one third of 55° CA. In this way, the timing rotor 26 has the reference teeth 28, each of which is correlated with the ignition timing of the corresponding cylinder.

Furthermore, the timing rotor 26 of the present embodiment has a non-toothed portion (absent portion) 29, which enables the rotation angle sensor 30 to sense a reference rotational angle. An angular interval (angular extent) of the non-toothed portion 29 is set to be 66° 40', which is three times or more greater than the equal angular interval of the teeth 28. With this construction, it is possible to reliably sense the reference rotational angel. In a case where the teeth 28 are arranged at equal intervals, each of which is set to be a quotient of the angular interval between the top dead center of the one piston 22 and the top dead center of the other piston 22 divided by N (N being an integer number equal to or greater than 2), an unequal interval of the teeth 28, which is different from the equal intervals, is created. When this unequal interval is used, it is possible to sense the reference rotational angle. However, when this unequal interval is made smaller than the equal interval, it may become difficult to sense the reference rotational angle. This is due to the following reason. That is, each equal interval cannot be made larger because of the above reason. Thus, when the unequal interval is made smaller than each equal interval, a difference between the unequal interval and the equal interval cannot be made sufficiently large. As a result, the difference between the unequal interval and the equal interval cannot be sensed by the rotational angle sensor 30 due to the influences of the rotational fluctuations of the crankshaft 24. In the present embodiment, with respect to this point, the unequal interval is made as the non-toothed portion 29, the interval of which is longer than each equal interval. In this way, the difference between the unequal interval (the interval of the non-toothed portion 29) and the equal interval can be made sufficiently large to permit the rotational angle sensor 30 to sense the difference regardless of the rotational fluctuations.

Figure 3:
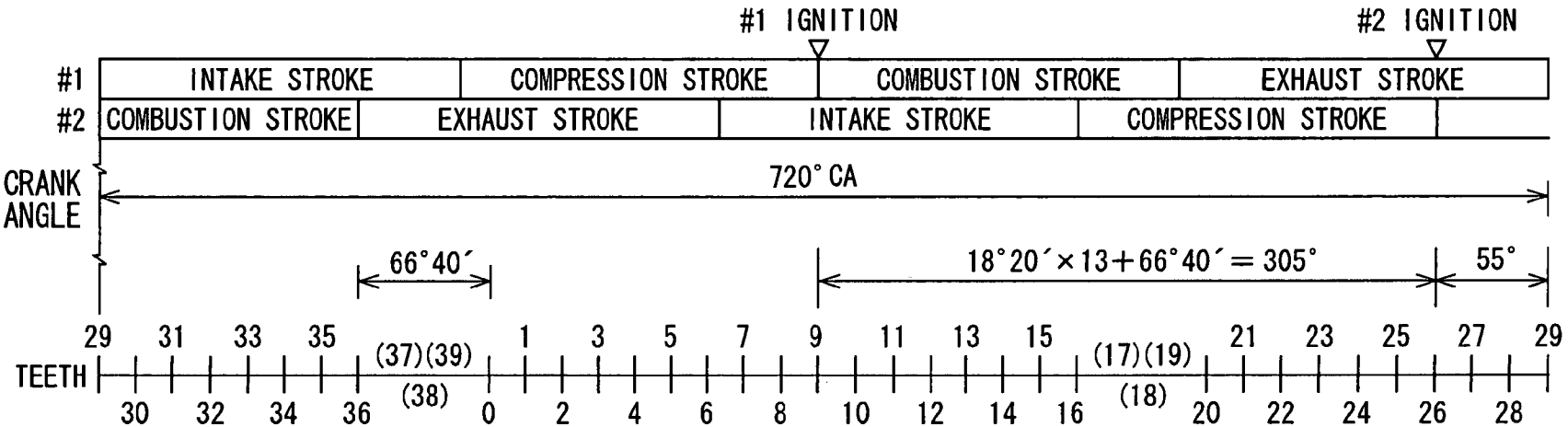
FIG. 3 is a diagram showing a relationship between teeth of the timing rotor and strokes of a combustion cycle according to the first embodiment.

FIG. 3 shows a relationship between respective teeth 28 of the timing rotor 26 and respective strokes of the gasoline engine 10, which is formed as a four-stroke engine.

As shown in FIG. 3, a compression top dead center of the first cylinder (#1 in FIG. 3) and a compression top dead center of the second cylinder (#2 in FIG. 3) are spaced from each other by 305°. The non-toothed portion 29 is provided to include a piston bottom-dead center, which is located between an intakestroke and a compression stroke of the first cylinder.

Now, the description will be made with respect to various control operations, which are performed through use of the timing rotor 26 and the rotational angle sensor 30 based on the measured rotational angle of the crankshaft 24.

Figure 4:
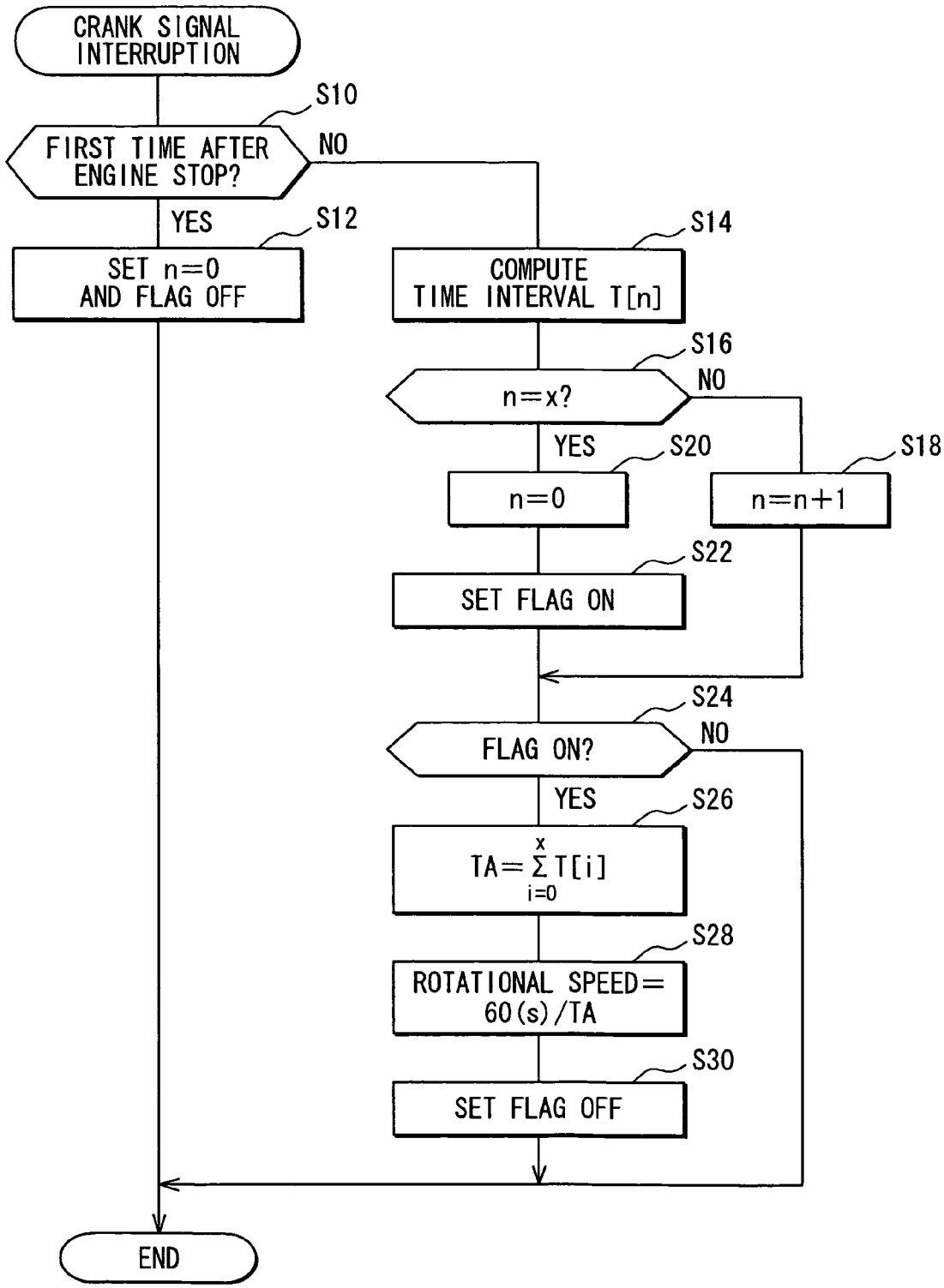
FIG. 4 is a flowchart showing an operational procedure for computing a rotational speed according to the first embodiment.

First, a computing method for computing the rotational speed of the crankshaft 24 will be described. FIG. 4 shows an operational procedure for computing the rotational speed of the crankshaft 24 according to the present embodiment. The ECU 40 executes this operation synchronously with reception of a measurement signal of the rotational angle sensor 30, which indicates the sensed tooth 28.

At step S10, it is determined whether a measurement signal of the rotational angle sensor 30, which indicates the sensed tooth 28, is supplied to the ECU 40 first time after stopping the gasoline engine 10. Here, when the gasoline engine 10 is started after engine stall, or when an ignition switch is turned on after turning off of the ignition switch, the crankshaft 24 begins to rotate, and it is determined whether the measurement signal of the rotational angle sensor 30, which indicates the sensed tooth 28, is supplied to the ECU 40 first time. When it is determined that the measurement signal of the rotational angle sensor 30, which indicates the sensed tooth 28, is supplied to the ECU 40 first time at step S10 (i.e., YES at step S10), a counter n is initialized (n=0), and a computation enabling flag is turned off.

In contrast, when it is determined that this is not the first time receiving the measurement signal of the rotational angle sensor 30, which indicates the sensed tooth 28, at step S10, the ECU 40 moves to step S14. At step S14, a time interval T[n] between the current measurement signal and the previous measurement signal is computed. Then at step S16, it is determined whether the counter n is equal to a predetermined number x. The predetermined number x is set to be "(the number of the teeth 28)−1". When it is determined that the counter n is not equal to the predetermined number x at step S16, the ECU 40 proceeds to step S18. In contrast, when it is determined that the counter n is equal to the predetermined number x at step S16 (i.e., YES at step S16), the ECU 40 proceeds to step S20. At step S20, the counter n is initialized. Then, at step S22, the computation enabling flag is turned on.

When step S18 or step S22 is completed, the ECU 40 moves to step S24. At step S24, it is determined whether the computation enabling flag is turned on. When it is determined that the computation enabling flag is turned on at step S24 (i.e., YES at step S24), the ECU 40 moves to step S26. At step S26, the ECU 40 adds every computed time period T[n] from n=0 to x to compute a required time period TA for making rotation of 360° CA. Then, the ECU 40 moves to step S28 where the rotational speed of the crankshaft 24 is computed by "60/TA". Then, at step S30, the computation enabling flag is turned off.

When step S12 is completed, or when NO is returned at step S24, or when step S30 is completed, the current operation is terminated.

Figure 5:
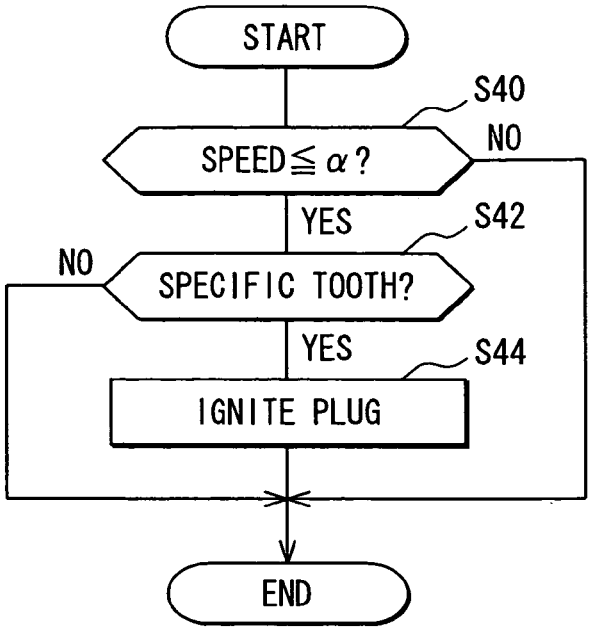
FIG. 5 is a flowchart showing a part of an operational procedure of an ignition timing control operation according to the first embodiment.

Next, the ignition timing control operation at the low speed rotation time period of the gasoline engine 10 will be described with reference to FIG. 5. The ECU 40 repeats this operation at predetermined intervals.

In this operation, at step S40, it is determined whether the rotational speed, which is computed in the operation of FIG. 4, is equal to or less than a predetermined speed a. The rotational fluctuations of the crankshaft 24 have significant influences on the speed $\alpha$, and this speed $\alpha$ is used to determine whether it is difficult to appropriately perform the fine adjustment of the ignition timing to the rotational angle, which is spaced from the corresponding tooth 28. When it is determined that the computed rotational speed is equal to or less than the predetermined speed $\alpha$ at step S40 (i.e., YES at step S40), the ECU 40 proceeds to step S42. At step S42, it is determined whether a corresponding specific tooth 28, which corresponds to timing (time point) adjacent to the compression top dead center of the corresponding cylinder, is sensed. This determination is made based on the output of the rotational angle sensor 30 and the output of the cam angle sensor 32.

When the specific tooth 28 is sensed at step S42 (i.e., YES at step S42), the ECU 40 proceeds to step S44. At step S44, the ECU 40 ignites the spark plug 20 of the corresponding cylinder.

In contrast, when NO is returned at step S40 or step S42, or when the operation at step S44 is completed, the current operation is terminated.

Figure 6:
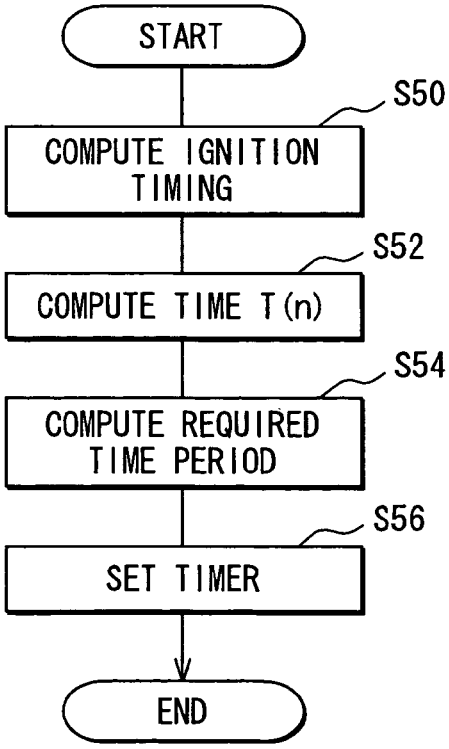
FIG. 6 is a flowchart showing anther part of the operational procedure of the ignition timing control operation according to the first embodiment.

FIG. 6 shows the operational procedure of controlling the ignition timing, which is executed upon receiving NO at step S40. The ECU 40 repeats this operation at predetermined intervals.

At step S50, the ignition timing is computed as the corresponding rotational angle based on the operational state of the gasoline engine 10. At next step 552, a required time period T(n), which is a required rotational time interval between adjacent two teeth 28, i.e., which is required from the time of sensing one of the adjacent two teeth 28 and the time of sensing the other one of the adjacent two teeth 28 upon rotation of the timing rotor 26, is computed. Then, at step S54, a required time period, which is required from the time of sensing the specific tooth 28 with the rotational angle sensor 30 and the above ignition timing of the corresponding spark plug 20, is computed based on the time T(n), which is computed at step S52. The time T(n) corresponds to the local rotational speed, which is measured between the adjacent two teeth 28. At step S56, the predetermined time period, which starts from the time of sensing the specific tooth 28, is set in the timer, and the spark plug 20 is ignited when the predetermined time period elapses.

Figures 7A, 7B:
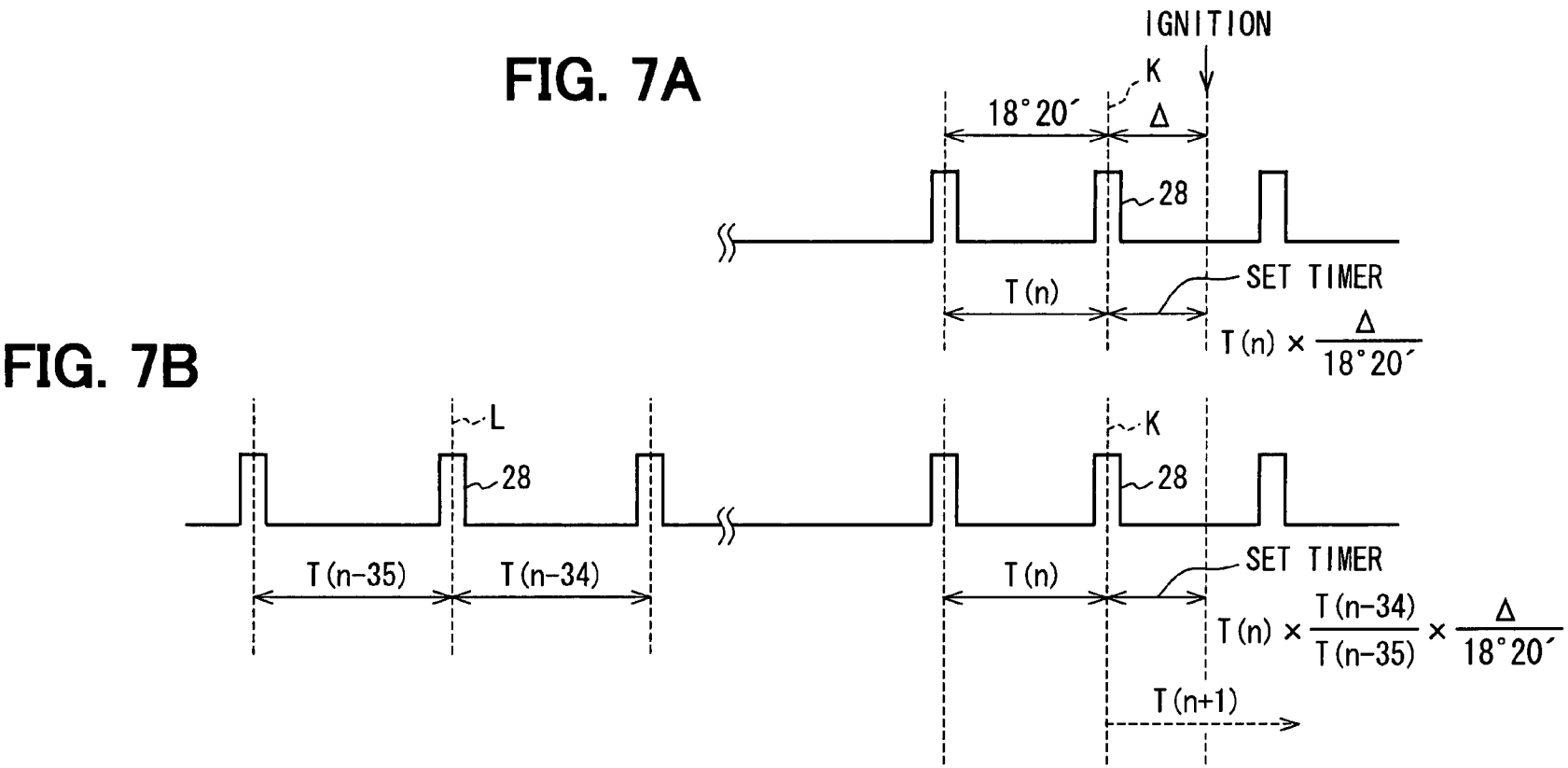
FIG. 7A is a time chart showing an operational procedure of the ignition timing control operation according to the first embodiment.
FIG. 7B is a time chart showing another operational procedure of the ignition timing control operation according to the first embodiment.

The above steps S52-S56 will be described in detail with reference to FIGS. 7A and 7B. In FIGS. 7A and 7B, the timing rotor 26 is rotated to move the teeth 28 in the left direction in the drawing, so that the left side of the drawing will be referred to as the leading side (or advanced side), and the right side of the drawing will be referred to as the trailing side (or retarded side). FIG. 7A shows one example of the above operation. In the example of FIG. 7A, a required rotational time interval between two teeth 28, which is measured right before the ignition timing of the spark plug 20, is set as the time period T(n), and the above required time period from the time of sensing the specific tooth 28 (located in a current rotational angle K in FIG. 7A) to the ignition timing is computed based on this time period T(n). Here, the time period T(n) corresponds to the rotational speed, which is measured between the two teeth 28 right before the ignition timing. Furthermore, it is assumed that this rotational speed approximates to a rotational speed of the crankshaft 24 that is measured from the time of sensing the specific tooth 28, which is right before the ignition timing, to the ignition timing. Specifically, a rotational angle (a rotational angular range) Δ, which is from the tooth 28 right before the ignition timing to the ignition timing, is used to compute the required time period that is equal to T(n)×Δ/18° 20'.

In place of the example shown in FIG. 7A, another example shown in FIG. 7B may be used. In the example of FIG. 7B, a criterion rotational angle L, which is on a leading side (the left side in FIG. 7B) of the current rotational angle K and is spaced from the current rotational angle K by a predetermined amount, is referred. Here, a trailing side criterion angular region and a leading side criterion angular region, which are located on a trailing side (the right side in FIG. 7B) and a leading side (the left side in FIG. 7B), respectively, of the criterion rotational angle L in the rotational direction of the timing rotor 26, are monitored. Specifically, a required rotational time interval, which is between a start point and an end point of the trailing side criterion angular region, and a required rotational time interval, which is between a start point and an end point of the leading side criterion angular region, are obtained. Then, the required rotational time interval of the trailing side criterion angular region and the required rotational time interval of the leading side criterion angular region are used to predict a relationship between a required rotational time interval of a trailing side subject angular region, which is located on a trailing side of the current rotational angle K, and a required rotational time interval of a leading side subject angular region, which is located on a leading side of the current rotational angle K. Thereafter, the above required time period is computed based on the predicted relationship between the required rotational time interval of the trailing side subject angular region and the required rotational time interval of the leading side subject angular region. In the example of FIG. 7B, the above predetermined amount is set to be 720° CA, and the tooth 28, which is right before the ignition timing, is set as the current rotational angle K. Furthermore, the leading side subject angular region is set to be between the specific tooth 28 (i.e., the tooth 28 that is right before the ignition timing) and the next leading side tooth 28, and the required rotational time interval of this leading side subject angular region is denoted by T(n). Also, the trailing side subject angular region is set to be between the specific tooth 28 and the next trailing side tooth 28, and the required rotational time interval of this trailing side subject angular region is denoted by T(n+1). In addition, the leading side criterion angular region is set to be between the tooth 28 at the criterion rotational angle L (the rotational angle that is spaced 720° CA from the specific tooth 28 on the leading side of the specific tooth 28) and the next leading side tooth 28, and the required rotational time interval of this leading side criterion angular region is denoted by T(n−35). Furthermore, the trailing side criterion angular region is set to be between the tooth 28 at the criterion rotational angle L and the next trailing side tooth 28, and the required rotational time interval of this trailing side criterion angular region is denoted by T(n−34). Here, it is assumed that the relationship between T(n) and T(n+1) is the same as the relationship between T(n−35) and T(n−34). Based on this assumption, the rotation between the specific tooth 28 and the next trailing side tooth 28, which is sensed next, is predicted. Therefore, based on the rotational angle (the rotational angular range) A between the specific tooth 28 and the ignition timing, the above required time period is computed as T(n)×(T(n−34)/T(n−35))×Δ/18° 20'.

In the ignition timing control operation, besides the ignition timing for generating a spark from the spark plug 20, it is also desirable to control the timing for accumulating energy in the spark plug 20. This timing control can be performed in a manner similar to that of FIG. 7A or 7B. The method for setting the timing for accumulating the energy in the spark plug 20 as well as the details of some operational steps described with reference to FIG. 7B may be implemented in a manner similar to those discussed in, for example, Japanese Unexamined Patent Publication Number 2005-48644 (corresponding to U.S. Pat. No. 6,961,652B2 content of which is incorporated herein by reference).

Figure 8:
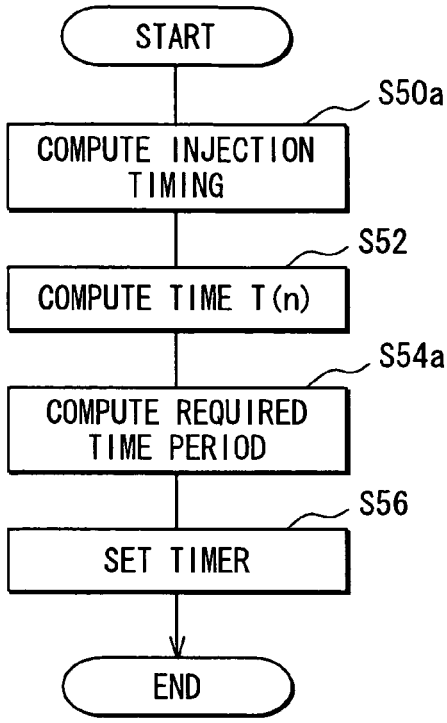
FIG. 8 is a flowchart showing an operational procedure of a fuel injection control operation according to the first embodiment.

Next, the fuel injection control operation according to the present embodiment will be described. FIG. 8 shows an operational procedure of the fuel injection control operation. The ECU 40 repeats this operation at predetermined intervals. In FIG. 8, steps similar to those discussed with reference to FIG. 6 are indicated by the same numerals.

At step S50*a*, the injection timing is computed based on the operational state of the gasoline engine 10. Then, step similar to step S52 of FIG. 6 is performed. Next, at step S54*a*, a required time period from the time of sensing the specific tooth 28 to the injection timing is computed in a manner similar to that of step S54 of FIG. 6. Thereafter, at step S56, the timer is set based on the required time period from the time of sensing the specific tooth 28 to the injection timing in a manner similar to that of FIG. 7A or 7B. Then, the fuel injection from the fuel injection valve 14 is performed upon elapse of the required time period.

The present embodiment provides the following advantages.

(1) The teeth 28 of the timing rotor 26 are arranged at the equal intervals, each of which is set as the quotient of the rotational angle between the top dead center of the one cylinder and the top dead center of the other cylinder divided by the integer number. In this way, each specific tooth 28 can be provided at the predetermined corresponding angle, which corresponds to the time point adjacent to the top dead center of the corresponding cylinder, and the teeth 28 can be arranged at the equal intervals.

(2) The non-toothed portion 29, which has no tooth 28, is provided in the timing rotor 26, and the angular interval (angular range, i.e., angular extent) of the non-toothed portion 29 is set to be greater than the above equal interval of the teeth 28. In this way, the reference angle can be appropriately sensed through use of the non-toothed portion 29.

(3) The angular range of the non-toothed portion 29 is set to be three times or more greater than the equal angular interval of the teeth 28. In this way, the reference angle can be more appropriately sensed by using the non-toothed portion 29.

(4) In the low speed operational state of the gasoline engine 10, the timing (time) of sensing the specific tooth 28, which corresponds to the timing (time point) adjacent to the compression top dead center and is sensed by the rotational angle sensor 30, is set as the ignition timing. In this way, even in the low speed operational state where the time period, which is required for the crankshaft 24 to make the specific angular rotation, cannot be accurately computed by sensing the corresponding tooth 28, the ignition timing can be accurately controlled.

(5) Based on the local rotational speed of the crankshaft 24 measured in the interval of at least two teeth 28 located on the advanced side of the compression top dead center of the corresponding cylinder, the required time period from the time of sensing the specific one of the teeth 28 to the ignition timing (operational timing) of that cylinder is set, and the ignition timing control operation is performed based on this required time period. In this way, the required time period from the time of sensing the specific one of the teeth 28 to the ignition timing can be accurately set.

(6) Based on the local rotational speeds of the crankshaft 24 measured in the interval of at least two teeth 28 located on the advanced side of the compression top dead center of the corresponding cylinder, the required time period from the time of sensing the specific one of the teeth 28 to the injection timing (operational timing) is set, and the fuel injection control operation is performed based on this required time period. In this way, the required time period from the time of sensing the specific one of the teeth 28 to the injection timing can be accurately set.

SECOND EMBODIMENT

With reference to the accompanying drawings, a second embodiment of the present invention will be described by mainly focusing on differences with respect to the first embodiment.

Figure 9:
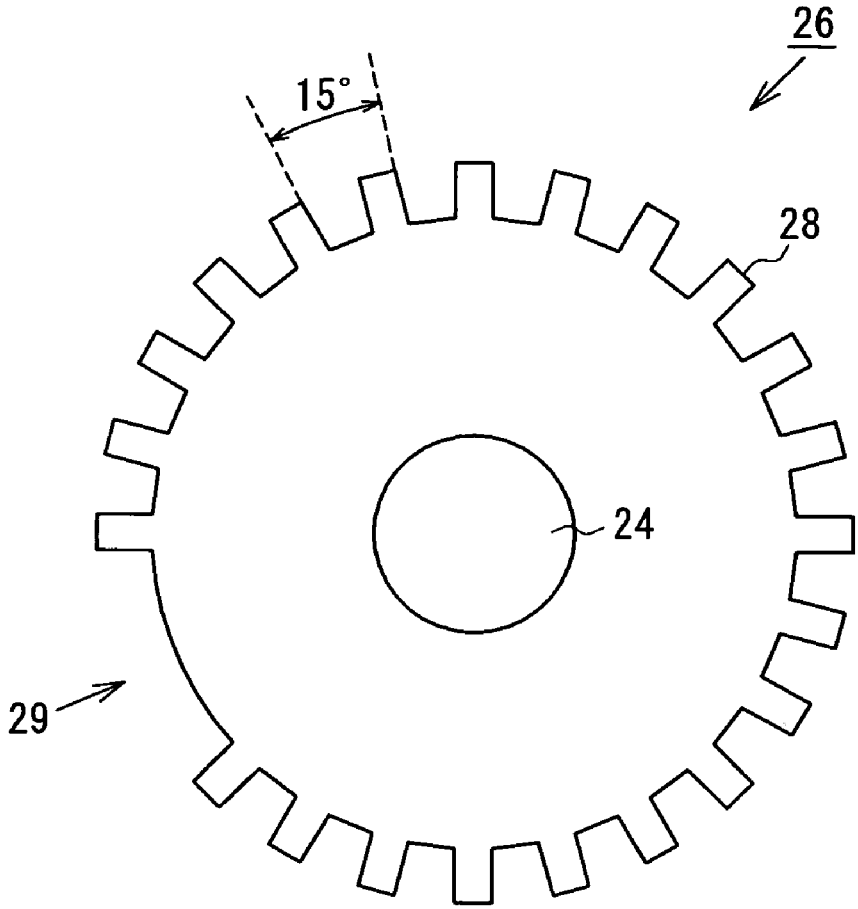
FIG. 9 is an enlarged plan view showing a structure of a timing rotor according to a second embodiment of the present invention.

FIG. 9 shows the timing rotor 26 according to the second embodiment of the present invention. In FIG. 9, components similar to those of FIG. 2 will be indicated by the same numerals and will not be described in detail.

As shown in FIG. 9, the teeth 28 are arranged generally at equal angular intervals of 15° CA, which is a quotient of a full rotational angle of the crankshaft 24 (360° CA) divided by an integer number. Furthermore, the angular interval (the angular range) of the non-toothed portion is generally set to be 45° CA. This timing rotor 26 provided for the gasoline engine 10 is one similar to a previously proposed timing rotor, which is used for an internal combustion engine of a four wheel automobile. However, in this case, the interval between the teeth 28 is not a multiple of 55° CA. Thus, in the predetermined operational state of the gasoline engine 10, the ignition timing, which serves as the reference timing of the corresponding cylinder, cannot be correlated to one of the teeth 28.

Figure 10:
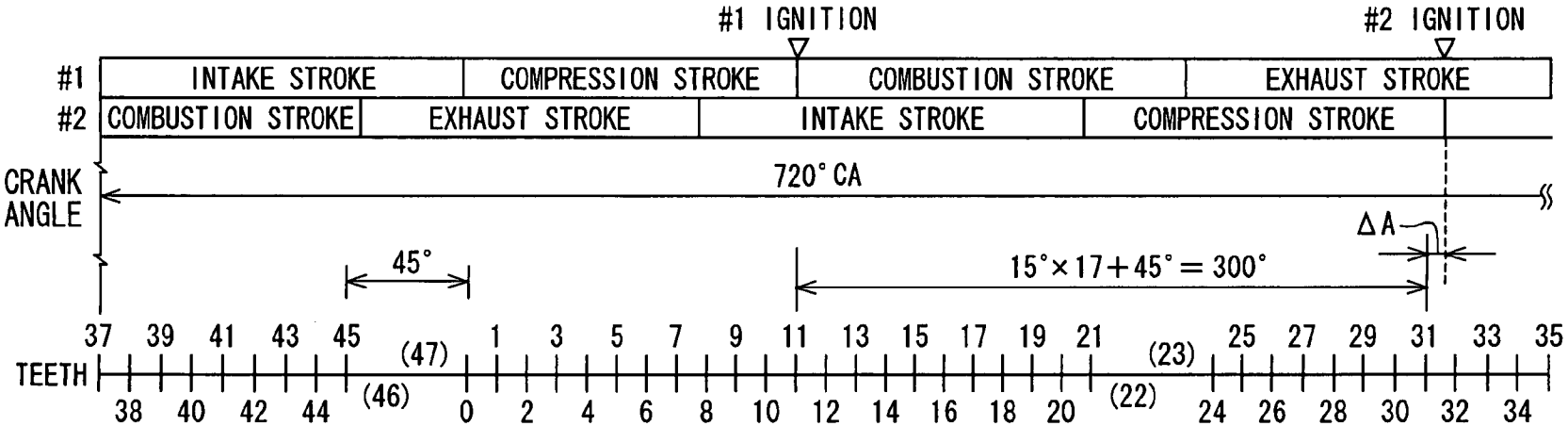
FIG. 10 is a diagram showing a relationship between teeth of the timing rotor and strokes of a combustion cycle according to the second embodiment.

Therefore, according to the present embodiment, the respective strokes of the gasoline engine 10, which is the four stroke engine, and the corresponding teeth 28 are set in a manner sown in FIG. 10. That is, the rotational angle, which corresponds to the ignition timing of the first cylinder (#1), coincides with the specific tooth 28. Specifically, it is now assumed that the tooth 28, which is closest to the non-toothed portion 29, is a 0th tooth 28. Under this assumption, an 11th tooth 28 coincides with the ignition timing of the first cylinder (#1). In this way, at the time of performing the low rotational speed operation of the gasoline engine 10, the time of sensing the 11th tooth 28 can be set as the ignition timing of the first cylinder (#1).

However, in this case, the rotational angle, which corresponds to the ignition timing of the second cylinder (#2), does no coincide with any of the teeth 28. Specifically, a space ΔA is provided between a 31st tooth 28 (the tooth that is closest to the ignition timing of the second cylinder on the advanced side) and rotational angle of the ignition timing of the second cylinder. Thus, in the present embodiment, regardless of the rotational speed of the gasoline engine 10, based on the local rotational speed of the crankshaft 24 between two or more sensing parts (teeth 28), which are located on the advanced side of the compression top dead center of the second cylinder, the time period between the one of the teeth 28 and the ignition timing of the second cylinder is predicated. The ignition operation is performed based on this time period.

Figure 11:
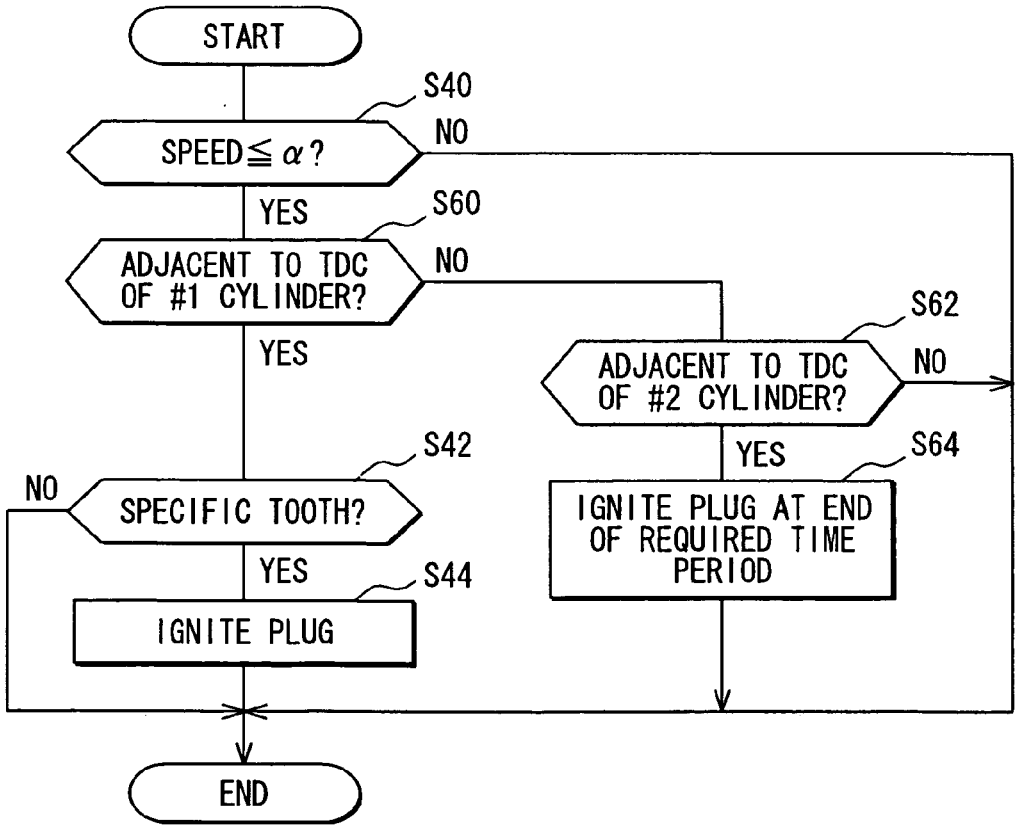
FIG. 11 is a flowchart showing an operational procedure of an ignition timing control operation according to the second embodiment.

FIG. 11 shows an operational procedure of the ignition timing control operation of the present embodiment at the time of performing the low rotational speed operation of the gasoline engine 10. The ECU 40 repeats this operation at predetermined intervals. In FIG. 11, steps similar to those discussed with reference to FIGS. 5 and 6 are indicated by the same numerals.

When it is determined that the rotational speed is equal to or less than the above rotational speed a at step S40 (i.e., YES at step S40), the ECU 40 proceeds to step S60. At step S60, it is determined whether the current position is in the specific position, which corresponds to the timing (time point) adjacent to the top dead center of the first cylinder. At this step, it is determined whether the current position is in a period, which is adjacent to the ignition timing of the first cylinder. Then, when YES is returned at step S60, the ECU 40 proceeds to steps S42, S44.

In contrast, when it is determined that the current position is not in the specific position that is adjacent to the top dead center of the first cylinder at step S60, the ECU 40 proceeds to step S62. At step S62, it is determined whether the current position is in the specific position that is adjacent to the top dead center of the second cylinder. At this step, it is determined whether the current position is in a period, which is adjacent to the ignition timing of the second cylinder. Then, when YES is returned at step S62, the ECU 40 proceeds to step S64. At step S64, a required time period from the time of sensing the one of the teeth 28 to the ignition time of the second cylinder is predicated, and the ignition timing control operation is performed based on this required time period. In the example of FIG. 10, the 31st tooth 28 is closest to the ignition timing of the second cylinder (#2) and is located on the advanced side of the ignition timing of the second cylinder (#2). Here, it is desirable to predict the required time period from the time of sensing the 31st tooth 28 to the ignition timing of the second cylinder (#2). The required time period may be predicted in a manner similar to the one described with reference to FIG. 6.

When NO is returned at step S40, S42 or S62, or when the operation at step S44 or step S64 is completed, the current operation is terminated.

The second embodiment provides the following advantages in addition to the advantages described in the above sections (1), (2), (5) and (6).

(7) The ignition timing (serving as the reference) of the first cylinder in the predetermined operational state of the gasoline engine 10 coincides with the specific tooth 28. In this way, the ignition timing of the first cylinder (#1) can be determined when the specific tooth 28 is sensed. Therefore, even in the predetermined operational state, the ignition timing can be set with high accuracy.

(8) Regardless of the rotational speed of the gasoline engine 10, based on the local rotational speed of the crankshaft 24 between the two or more teeth (at least two teeth) 28, which are located on the advanced side of the compression top dead center of the second cylinder (#2), the required time period from the one of the teeth 28 to the ignition timing (serving as the reference) of the second cylinder is predicted. Then, the end of this required time period is set as the ignition timing of the second cylinder (#2). In this way, the ignition timing of the second cylinder (#2) can be set with high accuracy in comparison to the case where the time of sensing the predetermined tooth 28 is set as the ignition timing of the second cylinder (#2).

Each of the above embodiments may be modified as follows.

Figures 12A, 12B, 12C:
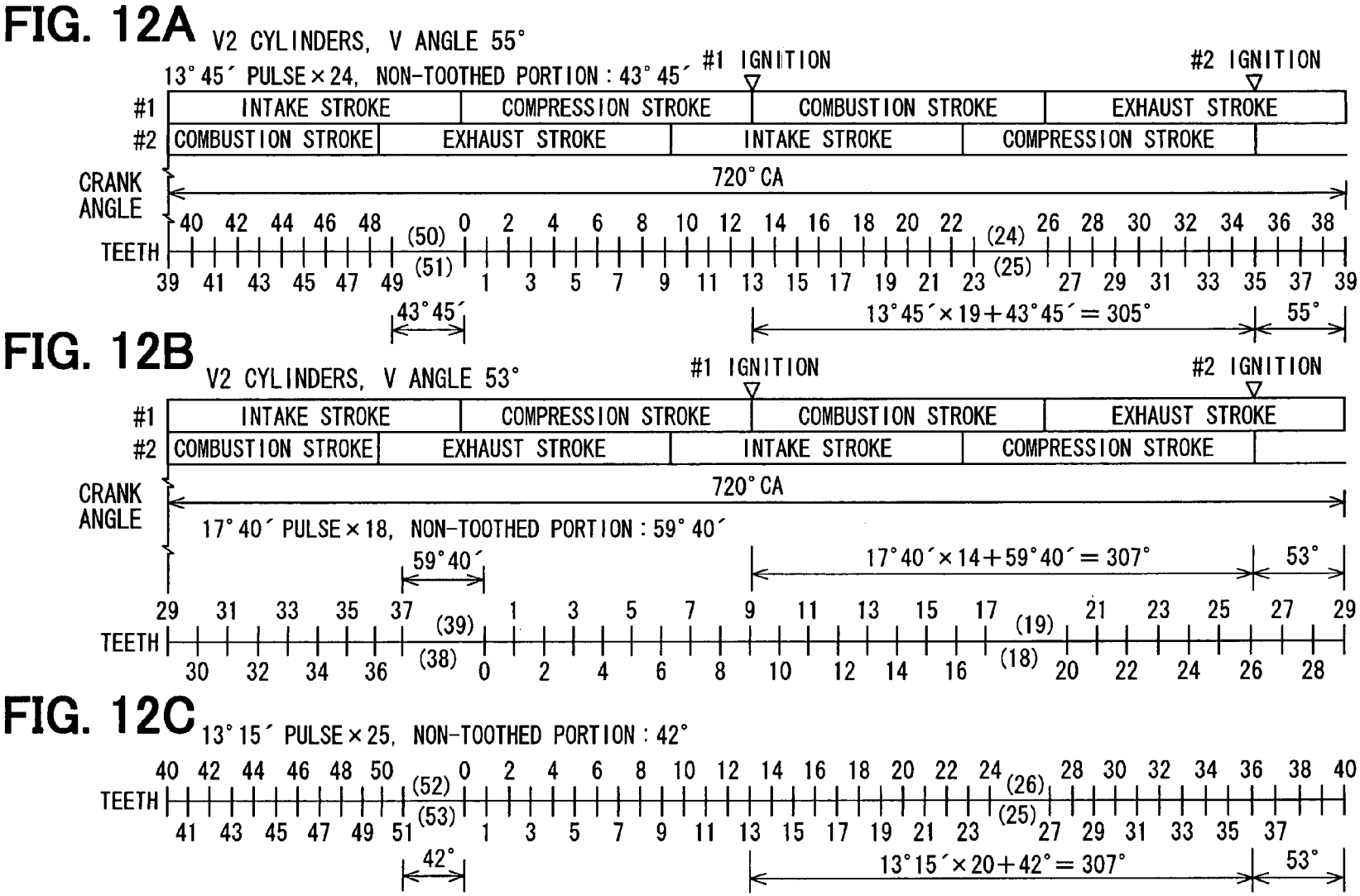
FIGS. 12A-12C are diagrams showing modifications of the timing rotor according to the first embodiment.

In the first embodiment, the interval of the teeth 28 may not be limited to 18° 20'. For example, FIG. 12A shows a case where twenty four teeth 28 are arranged at equal intervals of 13° 45', and the angular range of the non-toothed portion 29 is set to be 43° 45'. As in this case, the interval of the teeth 28 can be changed in the appropriate manner. However, when the interval of the teeth 28 is made too small, the computation load of the ECU 40 becomes excessively large. Therefore, at the time of setting the interval of the teeth 28, it is desirable to consider this fact. Particularly, in the case of the motorcycle, the rotational speed of the crankshaft 24 tends to be higher than that of the four wheel automobile. Thus, in order to reduce the computation load of the ECU 40, it is desirable to set the interval of the teeth 28 in a range of 10° CA to 20° CA.

The two cylinder V-type gasoline engine 10 is not limited to the above one, in which the angular interval θ between the top dead center of the one cylinder and the top dead center of the other cylinder is set to be 55° CA. FIGS. 12B and 12C show cases where this angular interval is set to be 53° CA. Specifically, FIG. 12B shows the case where eighteen teeth 28 are arranged at equal intervals of 17° 40', and the angular range of the non-toothed portion 29 is set to be 59° 40'. Furthermore, FIG. 12C shows the case where twenty five teeth 28 are arranged at equal intervals of 13° 15', and the angular range of the non-toothed portion 29 is set to be 42°.

In the second embodiment, the interval of the teeth 28 may not be limited to 15° CA. The advantages of the second embodiment can be implemented as long as the teeth 28 are arranged generally at equal intervals, each of which is a quotient of the full rotational angle of the crankshaft 24 (360° CA) divided by an integer number.

The above control operation, in which the timing of sensing the specific tooth 28 is set as the ignition timing, is not limited to the low rotational speed operation of the internal combustion engine. More specifically, the above control operation can be applied for the predetermined operational state of the internal combustion engine, in which it is difficult to accurately set the time period from the one of the teeth 28 to the ignition timing based on the local rotational speed. Furthermore, even in the case of the control system, which does not set the timing of the specific tooth 28 as the ignition timing, the present invention discussed in the first embodiment is effective as long as the control system sets the time period from the one of the teeth 28 to the ignition timing or the injection timing based on the local rotational speed. Here, desirably, the time of sensing the one of the teeth 28 and the ignition timing or the injection timing are set as close as possible to each other. It is thought that the accuracy in the setting of the above time period varies according to the size of the interval between the time of sensing the one of the teeth 28 and the ignition timing or the injection timing. Thus, when the interval of the teeth 28 is set to be a quotient of 360° CA divided by an integer number, the setting accuracy of the time period may possibly be varied from one cylinder to another cylinder. In contrast, when the present invention discussed in the first embodiment is applied, the time period between the time of sensing the one of the teeth 28 and the ignition timing or the injection timing can be kept the same among the cylinders. Therefore, the above disadvantage can be avoided.

In the above embodiment, the ignition timing control operation or the fuel injection control operation is performed once per four strokes. Alternatively, the ignition timing control operation or the fuel injection control operation may be performed twice per four strokes. That is, for example, in the first embodiment, in addition to the specific tooth 28, which corresponds to the time point adjacent to the compression top dead center, the ignition may be performed when a specific tooth 28 (this is physically the same as the above specific tooth 28), which corresponds to timing (time point) adjacent to an exhaust top dead center, is sensed. Furthermore, in the second embodiment, the ignition operation of the first cylinder may be performed when the specific tooth 28, which corresponds to both of the timing (time point) adjacent to the compression top dead center and the timing (time point) adjacent to the exhaust top dead center, is sensed. Also, the ignition operation of the second cylinder may be performed by setting both of the timing (time point) adjacent to the compression top dead center and the timing (time point) adjacent to the exhaust top dead center in the manner similar to the one discussed with reference to FIG. 6. In place of this, the ignition operation may be performed in each corresponding cylinder when the corresponding specific tooth 28 (the 11th tooth 28, the 31st tooth 28) is sensed.

In this way, even before completion of a cylinder identifying process, in which the corresponding rotational angles of the crankshaft 24 are correlated with strokes, respectively, of each cylinder in the four stroke engine, it is possible to make the combustion in the gasoline engine 10, and thereby it is possible to quickly perform the engine start.

The internal combustion engine is not limited to the gasoline engine and may be implemented as a diesel engine. Even is this case, the application of the present invention is effective to implement the accurate fuel injection control operation.

In the gasoline engine 10 of the above embodiment, which serves as the four stroke engine, the rotational angle, which is sensed with the rotational angle sensor 30, is correlated with the corresponding angle of the four strokes, through use of the cam angle sensor 32. However, the present invention is not limited to this. For example, an intake air pressure sensor, which senses the pressure in the intake air passage 12, may be provided. Based on the behavior of the intake air pressure, which is sensed by the intake air pressure sensor, each corresponding rotational angle measured with the rotational angle sensor 30 may be correlated with the corresponding angle of the four strokes.

The internal combustion engine is not limited to the two cylinder V-type engine. In essence, it is effective to apply the present invention to the multi-cylinder internal combustion engine, in which the angular interval between the piston top dead center of the one of two cylinders and the closest one of the piston top dead center and the piston bottom dead center of the other one of the two cylinders, which is closest to the piston top dead center of the one of the two cylinders, is not a quotient of a full rotational angle of the output shaft of the engine divided by an integer number. This is due to the fact that it is difficult to appropriately perform the ignition timing control operation and the fuel injection control operation in such an internal combustion engine where the teeth 28 are arranged at equal intervals, each of which is set as a quotient of 360° CA divided by an integer number.

The structure and the number of the sensing parts (teeth 28) of the timing rotor may be modified in any appropriate manner.

Additional advantages and modifications will readily occur to those skilled in the art. The invention in its broader terms is therefore not limited to the specific details, representative apparatus, and illustrative examples shown and described.

What is claimed is:

1. A control system for controlling an output of a two-cylinder V-type internal combustion engine that has a first cylinder and a second cylinder, each of which receives a corresponding piston therein, wherein an angular interval between a top dead center of the piston of the first cylinder and a closest one of a top dead center and a bottom dead center of the piston of the second cylinder, which is closest to the top dead center of the piston of the first cylinder, is not a quotient of a full rotational angle of an output shaft of the engine divided by an integer number, the control system comprising:

a timing rotor that is rotated synchronously with the output shaft and includes a plurality of sensing portions that are arranged at equal intervals, each of which is set as a predetermined quotient of the angular interval divided by a corresponding integer number; and a sensing means for sensing the plurality of sensing portions of the timing rotor.

2. The control system according to claim 1, wherein:

the timing rotor further includes an absent portion, in which none of the plurality of sensing portions is provided; and an angular extent of the absent portion is larger than an angular extent of each equal interval.

3. The control system according to claim 1, wherein:

the internal combustion engine is a gasoline engine; the control system further comprises an ignition timing setting means for setting at least ignition timing of the first cylinder; and the ignition timing setting means sets timing of sensing a specific one of the plurality of sensing portions, which is sensed by the sensing means, as the ignition timing of the first cylinder in a predetermined operational state of the engine.

4. The control system according to claim 1, wherein:

the internal combustion engine is a gasoline engine;

the control system further comprises an ignition timing setting means for setting at least ignition timing of the first cylinder; and the ignition timing setting means sets a time period from timing of sensing one of the plurality of sensing portions, which is sensed by the sensing means, to the ignition timing based on a local rotational speed of the output shaft, which is measured in an interval of at least two of the plurality of sensing portions located on an advanced side of a compression top dead center of the first cylinder.

5. The control system according to claim 1, further comprising:

a fuel injection quantity setting means for setting at least a fuel injection quantity in the first cylinder, wherein the ftiel injection quantity setting means sets a time period from timing of sensing one of the plurality of sensing portions, which is sensed by the sensing means, to fUel injection timing in the first cylinder based on a local rotational speed of the output shaft, which is measured in an interval of at least two of the plurality of sensing portions located on an advanced side of a compression top dead center of the first cylinder.

* * * * *